US007164330B2

(12) United States Patent
Eom

(10) Patent No.: US 7,164,330 B2
(45) Date of Patent: Jan. 16, 2007

(54) BROADBAND PHASE SHIFTER USING COUPLED LINES AND PARALLEL OPEN/SHORT STUBS

(75) Inventor: Soon-Young Eom, Daejon (KR)

(73) Assignee: Electronics and Telecommunications Research Institute (KR)

( * ) Notice: Subject to any disclaimer, the term of this patent is extended or adjusted under 35 U.S.C. 154(b) by 241 days.

(21) Appl. No.: 10/823,490

(22) Filed: Apr. 12, 2004

(65) Prior Publication Data

US 2004/0239447 A1 Dec. 2, 2004

(30) Foreign Application Priority Data

May 27, 2003 (KR) ..... 10-2003-0033797

(51) Int. Cl.
*H01P 1/18* (2006.01)

(52) U.S. Cl. ..... 333/161; 333/164

(58) Field of Classification Search ..... 333/156, 333/161, 164

See application file for complete search history.

(56) References Cited

U.S. PATENT DOCUMENTS 4,195,271 A * 3/1980 Schiek et al. ..... 333/161
4,612,520 A 9/1986 Boire et al.
6,320,481 B1 * 11/2001 Sharma ..... 333/164

OTHER PUBLICATIONS

Eom et al., "Braodband 180 degree Bit Phase Shifter Using a New Switched Network", IEEE MTT-S International, vol. 1, Jun. 8-13, 2003, pp. 39-42.*

Eom "A Study on a New Broadband 180 Phase Shifter Using the Network With Great Phase Dispersive Characteristics"; Korea Electromagnetic Engineering Society Foundation, vol. 14, No. 4, Apr. 20, 2003, pp. 401-412.

Wilds, "Try λ/8 Stubs for fast fixed phase shifts", Microwaves, Dec. 18, 1979, pp. 67.-68.

Quirarte etal., "Novel Schiffman phase shifters", IEEE Trans. Microwave theory & Tech. , vol. 41, No. 1, Jan. 1993, pp. 9-14.

Boire etal. "A 4.5 to 18 GHz phase shifter", IEEE MTT-S Digest, 1985, pp. 601-604.

* cited by examiner

*Primary Examiner*—Seungsook Ham
(74) *Attorney, Agent, or Firm*—Blakely Sokoloff Taylor & Zafman

(57) ABSTRACT

Provided is a broadband phase shifter using a coupled line and parallel open and short stubs. The broadband phase shifter of the present research has a new switching network structure by forming a coupled line, main transmission lines and parallel λ/8 (45°) open and short stubs on both ends of the main transmission lines in order to obtain broadband phase characteristic that the phase difference between two networks is uniform. The broadband phase shifter includes a first path network including a reference standard transmission line whose input/output characteristic impedance is $Z_0$ and electrical length is $\theta_1$; a second path network having two symmetrical main transmission lines connected to each other by a coupled line in the center and parallel open and short stubs connected to both ends of the two symmetrical main transmission lines, the main transmission lines having characteristic impedance $Z_m$ and an electrical length $\theta_m$ and the parallel open and short stubs having characteristic impedance $Z_s$ and an electrical length $\theta_s$; and a switching means for selecting only one path among the first path network and the second path network.

13 Claims, 19 Drawing Sheets

BROADBAND PHASE SHIFTER USING COUPLED LINES AND PARALLEL OPEN/SHORT STUBS

FIELD OF THE INVENTION

The present invention relates to a broadband phase shifter using coupled lines and parallel open and short stubs; and, more particularly, to a broadband phase shifter having a structure of a transmission-type switching network which includes a coupled line, main transmission lines and parallel λ/8 (45°) open and short stubs formed on both ends of the main transmission lines in order to obtain broadband phase characteristic that the phase difference between two networks is uniform.

DESCRIPTION OF RELATED ART

Generally, wireless communication systems, such as satellite communication, broadcasting, mobile communication and terrestrial communication, require various phased array antennas to be operated properly in a mobile environment. Electrical beams of the phased array antenna can be formed in a desired direction and a phase shifter is a key component of phased array antennas that is needed essentially to form the electrical beams.

The phase shifter is a device having two ports for changing the phase of radio frequency (RF) signals. It provides a phase difference required by a control signal, i.e., direct current bias voltage/current, between input and output signals. Ever since a semiconductor diode phase shifter is developed in 1960s, phase shifters have been developed actively in response to the necessity for phased array technology.

Phase shifters are largely divided into a digital type and an analogue type. Digital type phase shifters are further divided into ones using ferrite materials and ones using semiconductor (diode or field-effect transistor (FET)) materials.

The phase shifters using ferrite materials are suitable to high-power, small insertion loss, and high input/output match. The phase shifters using semiconductor materials are advantageous to obtain high switching rate, reciprocity, reliability, fine temperature characteristic, miniaturization and weight reduction.

The phase shifter using semiconductor materials has two types: transmission-type phase shifters and reflection-type phase shifters. The transmission-type phase shifters are divided again into an open/closed type and a loaded type. The reflection-type phase shifters are divided again into a circulator coupled type and a hybrid coupled type.

FIG. 1 is a graph showing typical phase shifting characteristics between two standard transmission lines according to frequency. Generally, a phase shifter with a simple structure which uses the difference in the electrical lengths of the transmission lines shows a phase deviation of $\pm\epsilon_{\Delta\phi}$, which is described in FIG. 1, due to the difference in the frequency-based phase characteristics within a specified band. The phase deviation is caused by the phase dispersion of the transmission lines and it is a major factor for restricting the operational bandwidth of the phase shifter.

In order to reduce the phase deviation within an operational frequency band, many kinds of networks have been studied and reported in many literatures. However, the networks have several drawbacks originated from their own characteristics and the drawbacks work as restrictions on them. Thus, the networks have been used limitedly.

The characteristics and problems of the conventional phase shifters are described herein. First, a phase shifter having the specific network which uses λ/8 open and short stubs is proposed in an article by R. B. Wilds entitled "Try λ/8 stubs for fast fixed phase shifts" in *Microwaves*, pp. 67–68, Vol. 18, December, 1979, which is incorporated herein by reference. The phase-delayed path of the phase shifter uses a standard transmission line having impedance $Z_0$, and the other path with a leading phase has parallel λ/8 (45°) open and short stubs in the center of a transmission line having a phase length of 180° (λ/2).

The phase shifter can shift phases optionally in the range of 15° to 135° over octave band. However, the phase shifter has a shortcoming that the phase shifting range is limited to 15° to 135°, as it is designed to be. Also, since the network of the path with a leading phase has a low impedance characteristic, it is not appropriate for a circuit with a dual-stub structurally.

Another conventional technology, a broadband 180° phase shifter is proposed in an article by Boire, et al. entitled "A 4.5 to 18 GHz Phase shifter" in *IEEE MTT Int. Microwave Symp. Digest*, pp. 601–604, 1985, which is incorporated herein by reference. The phase shifter has a structure in which phase characteristics are shown independently from frequency within the operational band. The phase shifter has a structure of a switched network having two paths. Each path has a coupled transmission line portion and a n hybrid-type network portion. The phase difference between the two paths is relative phase difference, which is 180°.

However, the phase shift of this phase shifter is fixed to 180° and it requires an additional input/output match circuit. The use of the input/output match circuit reduces the operational bandwidth. In addition, it has a drawback in manufacturing that it cannot be realized in a Hybrid Microwave Integrated Circuit (HMIC) technology, which is relatively simple, but formed in a Monolithic Microwave Integrated Circuit (MMIC) technology.

The drawback in manufacturing the broadband 180° phase shifter is also found in the manufacturing of a Schiffman phase shifter proposed in an article by B. M. Schiffman entitled "A new class of broad-band microwave 90-degree phase shifters" in *IRE Trans. Microwave Theory Tech.*, pp. 232–237, April 1958, which is incorporated herein by reference, and in an article by J. L. R. Quirarte and J. P. Starski entitled "Novel Schiffman phase shifters" in *IEEE Trans. Microwave Theory Tech.*, Vol.MTT-41, PP. 9–14, January 1993, which is incorporated herein by reference. The Schiffman phase shifter can hardly be realized in a thick film technology. The Schiffman phase shifter has a shortcoming in broadband design that bandwidth is decreased as coupling between transmission lines is weaker.

In conclusion, the phase shifters of the prior structures has a problem that their electrical characteristics are restricted due to the shortcomings in manufacturing and designing and the development cost, such as production cost, is expensive.

SUMMARY OF THE INVENTION

It is, therefore, an object of the present invention to provide a broadband phase shifter having a structure of a transmission-type switched network which includes a coupled line, main transmission lines and parallel λ/8 (45°) open and short stubs formed on both ends of the main transmission lines in order to obtain broadband phase characteristics that the phase difference between two networks is uniform.

In accordance with an aspect of the present invention, there is provided a broadband phase shifter, including: a first path network including a reference standard transmission line whose input/output characteristic impedance is $Z_0$ and electrical length is $\theta_1$; a second path network having two symmetrical main transmission lines connected to each other by a coupled line in the center and parallel open and short stubs connected to both ends of the two symmetrical main transmission lines, the main transmission lines having characteristic impedance $Z_m$ and an electrical length $\theta_m$ and the parallel open and short stubs having characteristic impedance $Z_s$ and an electrical length $\theta_s$; and a switching means for selecting only one path among the first path network and the second path network.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Other objects and aspects of the invention will become apparent from the following description of the embodiments with reference to the accompanying drawings, which is set forth hereinafter.

Figure 2A:
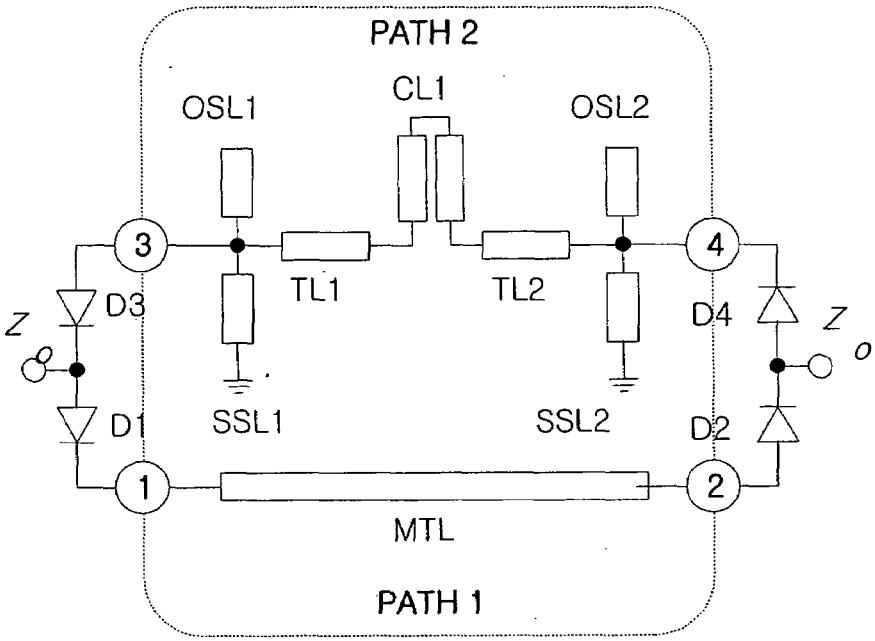
FIGS. 2A and 2B are schematic diagrams describing a network of a broadband phase shifter in accordance with the present invention.
Figure 2B:
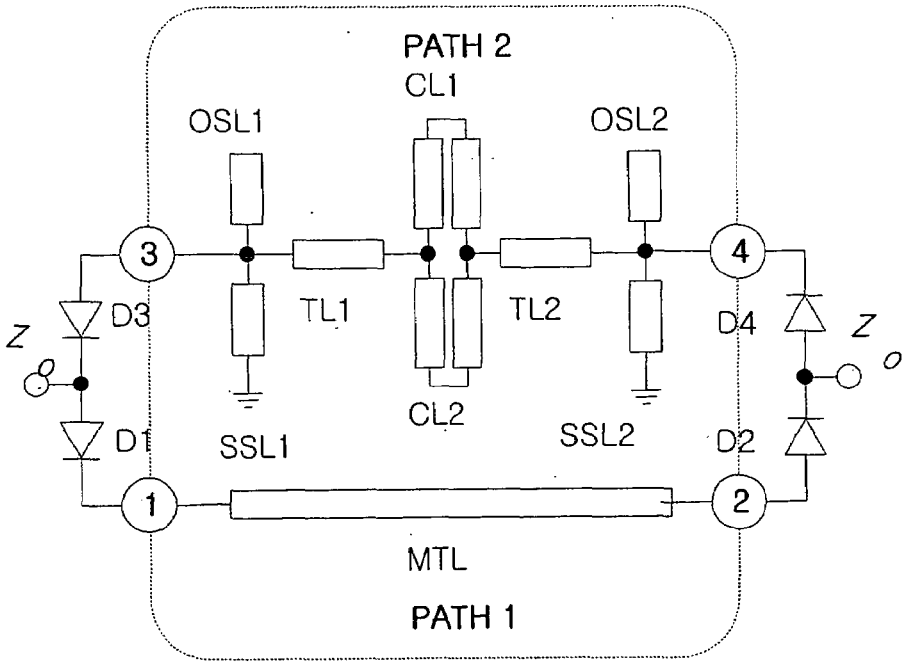

FIGS. 2A and 2B are schematic diagrams describing a network of a broadband phase shifter in accordance with the present invention. FIG. 2A shows a first embodiment where the network has a single coupled line and FIG. 2B shows a second embodiment where the network has double parallel coupled lines. The network of the broadband phase shifter of the present invention has two paths, and only one path is selected among the two through mutual toggle switching between a pair of diodes D1 and D2 and the other pair of diodes D3 and D4.

First, the network of the broadband phase shifter in FIG. 2A is described. Referring to FIG. 2A, the network includes a first path network, a second path network, and a switching unit.

The switching unit selects only one path among the first and second path networks through toggle switching between a pair of a first diode D1 and a second diode D2 and the other pair of a third diode D3 and a fourth diode D4. Here, the switching diodes can be replaced with other switching devices such as switching field effect transistors (FETs).

The first path network is a phase-delaying network. It is formed of standard transmission lines (MTL), which can control its electrical length according to a desired phase shift and control input/output characteristic impedance $Z_0$ according to the characteristics of a broadband phase shifter to be designed.

Figure 1:
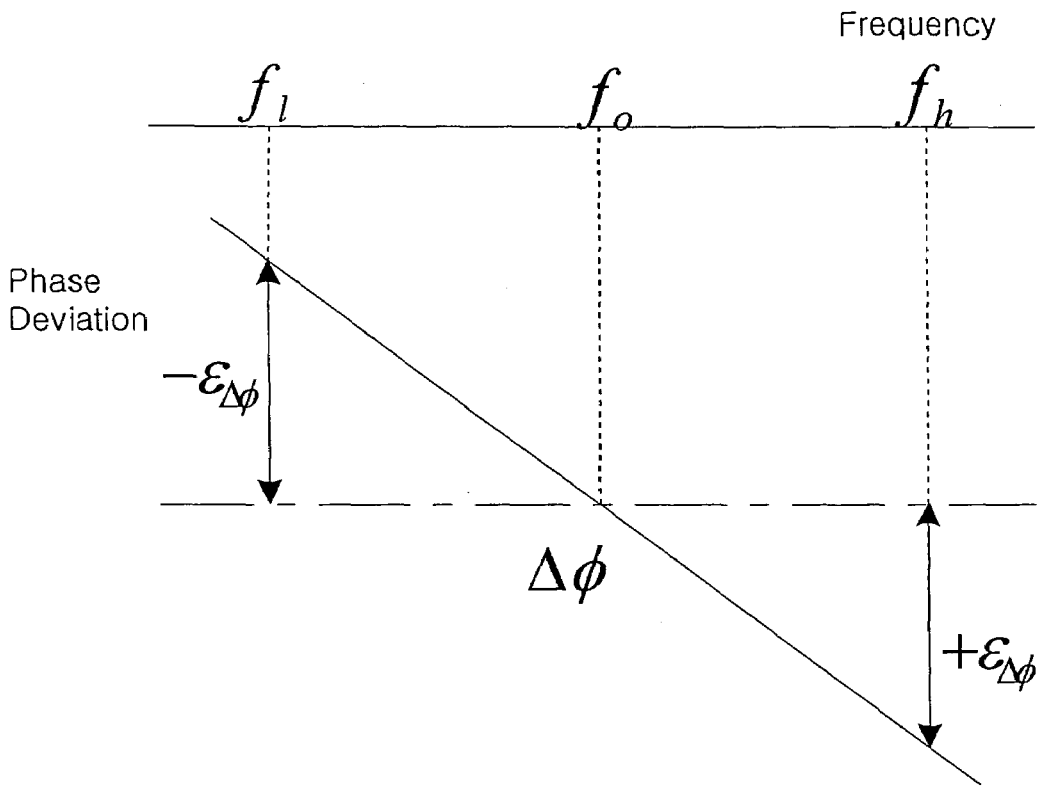
FIG. 1 is a graph showing typical phase shifting characteristics between two standard transmission lines according to frequency.

The electrical length $\theta_1$ of the standard transmission lines has a value obtained by adding a basic phase shift designed at the center frequency $f_0$, i.e., 180° ($\lambda/2$), to an additional electrical length for obtaining a desired phase shift. The additional electrical length of the standard transmission line shows typical characteristics of in-band phase deviation $\pm\epsilon_{\Delta\phi}$ (refer to FIG. 1). That is, the phase of the additional electrical length of the standard transmission line is delayed in a frequency band lower than the center frequency, and the phase goes ahead in a frequency band higher than the center frequency.

The second path network includes two symmetrical main transmission lines TL1 and TL2 and a coupled line CL1 in the center. The two symmetrical main transmission lines TL1 and TL2 have characteristic impedance $Z_m$ and an electrical length $\theta_m$. The coupled line CL1 has arbitrary coupling characteristics. The second path network also includes open and short stubs OSL1, OSL2, SSL1 and SSL2 connected in parallel at both ends of the network. The open and short stubs OSL1, OSL2, SSL1 and SSL2 have characteristic impedance $Z_s$ and an electrical length of $\lambda/8$ (45°).

The second path network comes to have a stronger dispersive phase characteristic than the first path network by connecting the open and short stubs OSL1, OSL2, SSL1 and SSL2 and by the coupled line CL1. The frequency-based phase slope of the second path network is obtained by controlling the electrical length $\theta_m$ (from 0° to 90°) of the main transmission lines TL1 and TL2, the characteristic impedance $Z_m$ of the main transmission lines TL1 and TL2, the characteristic impedance $Z_s$ of the parallel stubs OSL1, OSL2, SSL1 and SSL2, and coupling characteristics R of the coupled line CL1 in accordance with the desired phase shift.

The present invention uses an even mode and odd mode analysis and the superposition principle, which considers structural symmetry based on an ideal lossless transmission line theory, to analyze the structure of the phase shifter proposed in the present invention.

Meanwhile, the second path network of FIG. 2A has design parameters $Z_m$, $Z_{me}$, $Z_{mo}$, $Z_s$, $\theta_m$, $\theta_c$ and $\theta_s$. Among the design parameters, the $\theta_s$ value is 45° at the center frequency independently. To satisfy the electrical characteristics of the network at the center frequency, the $Z_{me}$, $Z_{mo}$, and $\theta_c$ values should satisfy the relations expressed in Equations 1, 2, and 3.

$$Z_{me} = \sqrt{R}\, Z_m \quad \text{Equation 1}$$

$$Z_{mo} = \frac{Z_m}{\sqrt{R}} \quad \text{Equation 2}$$

$$\theta_c = \tan^{-1}\left(\sqrt{R\left\{\frac{1-\cos(180^\circ - 2\theta_m)}{1+\cos(180^\circ - 2\theta_m)}\right\}}\right) \quad \text{Equation 3}$$

where $R=Z_{me}/Z_{mo}$, and the entire electrical length of the main transmission line and the coupled line is 180° at the center frequency.

From the condition for the electrical length, Equation 3 can be derived as above, and the characteristic impedance $Z_m$ of the main transmission line can be changed while the input/output match is maintained.

The other parameters $Z_m$, $Z_s$ and $\theta_m$ of the second path network and the parameter R that determines the coupling characteristics of a new coupled line decide phase dispersive characteristics (or phase slope) of the network. They can be determined arbitrarily by considering input/output match fixed at the desired phase shift and design conditions for phase deviations. Each parameter should be determined to form the circuit network easily. Graphs for the relationships for the design parameters $Z_m$, $Z_s$, $\theta_m$ and R will be described in detail later.

The input/output impedance of the first path network of the broadband phase shifter of FIG. 2A is already matched. In connection with the transmission characteristics, the size of the input/output impedance is always 1 and only its phase is delayed by $\theta_1$.

As described above, the structures of the phase shifters of FIGS. 2A and 2B can be applied to designing common phase shifters for arbitrary phase shift. To be specific, the reference network of a second path can provide twice as stronger phase dispersive characteristics by coupling the parallel open and short stubs OSL1, OSL2, SSL1 and SSL2 with the coupled lines CL1. Therefore, it is very suitable for designing a broadband phase shifter having a relatively large phase shift, e.g., 180°.

The 180° phase shifter is the important bit phase shifter that most affects electrical characteristics, i.e., bandwidth characteristic, when a digital phase shifter is designed. The phase dispersive characteristic by the parallel open and short stubs OSL1, OSL2, SSL1 and SSL2 on the reference network are superior to the phase dispersive characteristic by the coupled lines CL1 and CL2. A process for designing the 180° phase shifter of the present invention will be described in detail, hereafter.

In order to optimize the frequency-based input/output impedance match and phase characteristics, the design parameters $Z_m$, $Z_s$, $\theta_m$, and R should be selected to make an optimal relationship through computer simulation. The impedance ratio R of the coupled lines CL1 and CL2 that can be manufactured in a Hybrid Microwave Integrated Circuit technology using a substrate of a low dielectric constant is no more than 1.7 in general.

Thus, if a 180° phase shifter is to be manufactured in the HMIC technology, the design parameters may be determined to satisfy the design conditions that the R=1.7; the input/output voltage standing wave ratio (VSWR) is 1.15:1 (VSWR=1.15:1); and a maximum phase deviation is no more than ±2. The VSWR 1.15:1 corresponds to return loss characteristic 23.12 dB. The $Z_m$ and $Z_s$ values are given optimally by the variable value of $\theta_m$ through computer simulation, as shown in FIG. 3.

Figure 3:
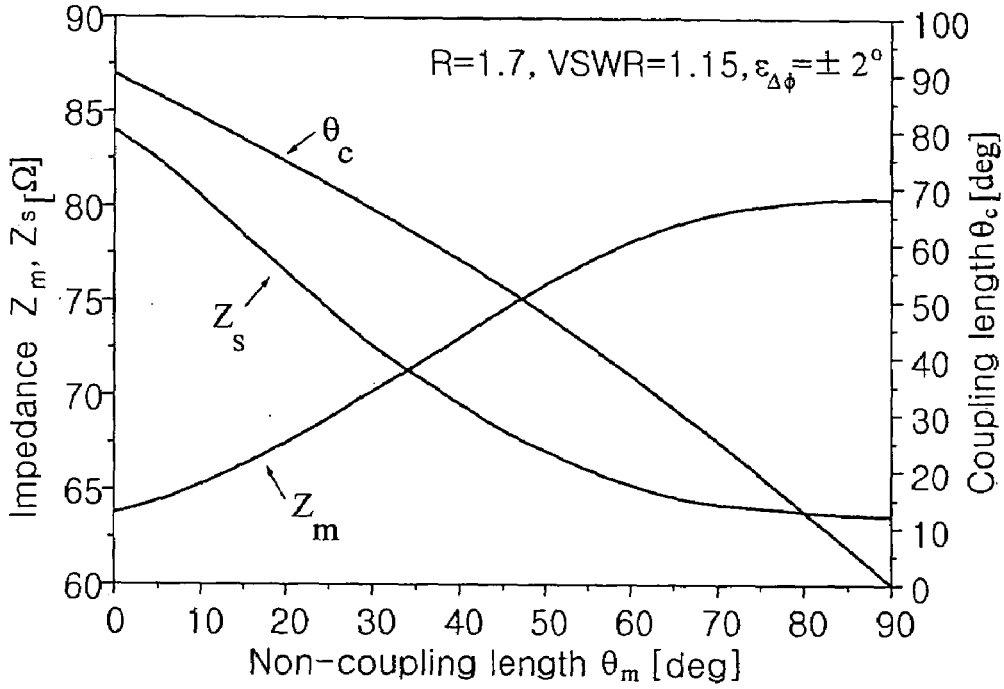
FIG. 3 is a graph showing optimal $Z_m$ and $Z_s$ values by $\theta_m$ variations.

FIG. 3 is a graph showing optimal $Z_m$ and $Z_s$ values by $\theta_m$ variations. According to the relationship between the characteristic impedance $Z_m$ of the main transmission lines TL1 and TL2 and the characteristic impedance $Z_s$ of the stubs OSL1, OSL2, SSL1 and SSL2, which satisfies the design conditions of the input/output match and the maximum phase deviation provided from the graph of FIG. 3 simultaneously, the $Z_m$ value is increased nonlinearly and the $Z_s$ value is decreased nonlinearly, as the $\theta_m$ value is increased. Particularly, if the $\theta_m$ value is around 34.3°, the $Z_m$ and $Z_s$ values have the same value. Also, the input/output match and phase bandwidths in the same design conditions have the relationship shown in the graph of FIG. 4, as the $\theta_m$ value is changed.

Figure 4:
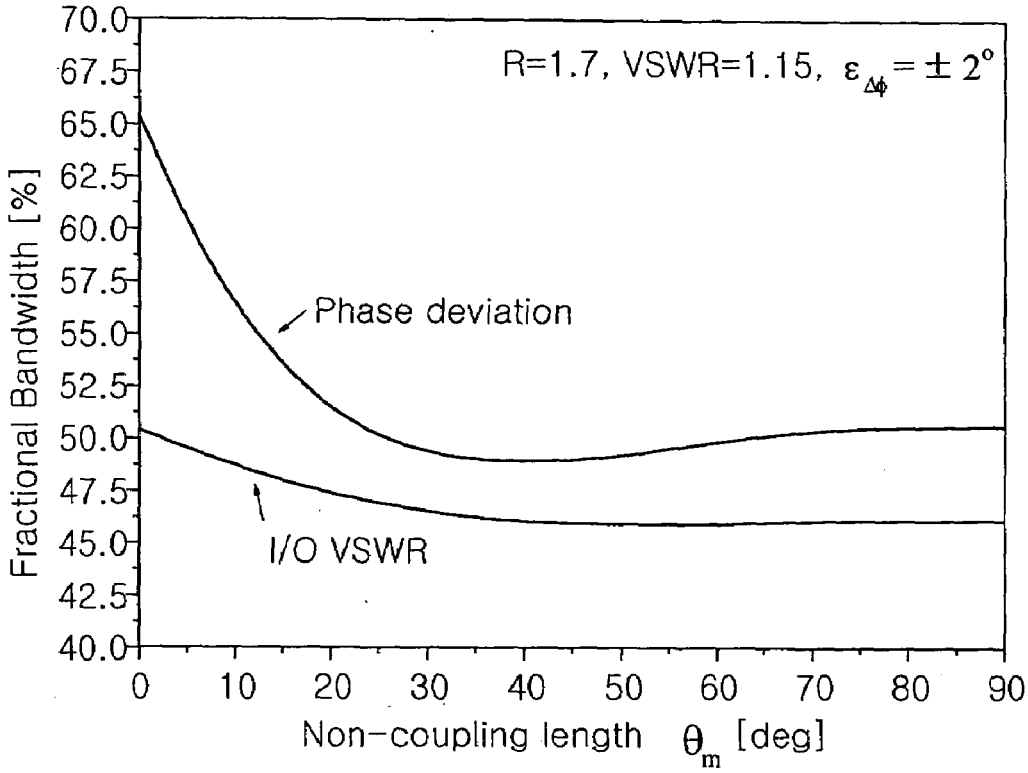
FIG. 4 is a graph presenting an input/output voltage standing-wave ratio (VSWR) and a phase bandwidth by $\theta_m$ variations.

If the $Z_m$ and $Z_s$ values of the graph in FIG. 3 which satisfy the given design conditions of input/output match and the maximum phase deviation are applied and the $\theta_m$ value is increased as shown in FIG. 4, the input/output VSWR bandwidth is decreased gently and maintains almost the same value where the value of the $\theta_m$ value is more than about 40°. On the other hand, the phase response bandwidth is decreased steeply until the $\theta_m$ value becomes about 30°. When the $\theta_m$ value becomes 90°, the $\theta_c$ value becomes 0 and, thus, the phase dispersive characteristic of the coupled lines CL1 and CL2 disappears on the second path network.

Referring to FIG. 4, if the R value is 1.7 and the effect of increased input/output VSWR bandwidth and increased phase response bandwidth caused by the phase dispersive characteristic of the coupled lines should be obtained, it can be seen from the graph that the electrical length $\theta_m$ of the main transmission lines should be no more than 23.3°. The maximum input/output VSWR bandwidth and phase response bandwidth are obtained when their $\theta_m$ values are 0° and they have values of 50.6% and 65.2%, respectively.

Hereinafter, the circuit design parameters according to the impedance ratio R of the coupled lines CL1 and CL2 will be described in detail, when the electrical length $\theta_m$ of the main transmission lines TL1 and TL2 is 0°.

Hereafter, the design condition that the input/output VSWR is 1.15:1 and the maximum phase deviation is no more than ±2 will be referred to as design condition I. The design condition that the input/output VSWR is 1.25:1, which corresponds to a return loss characteristic 19.08 dB, and the maximum phase deviation is no more than ±5 will be referred to as design condition II. The $Z_m$ and $Z_s$ values that satisfy both of the design conditions I and II are given optimally by R variations, as described in FIG. 5.

Figure 5:
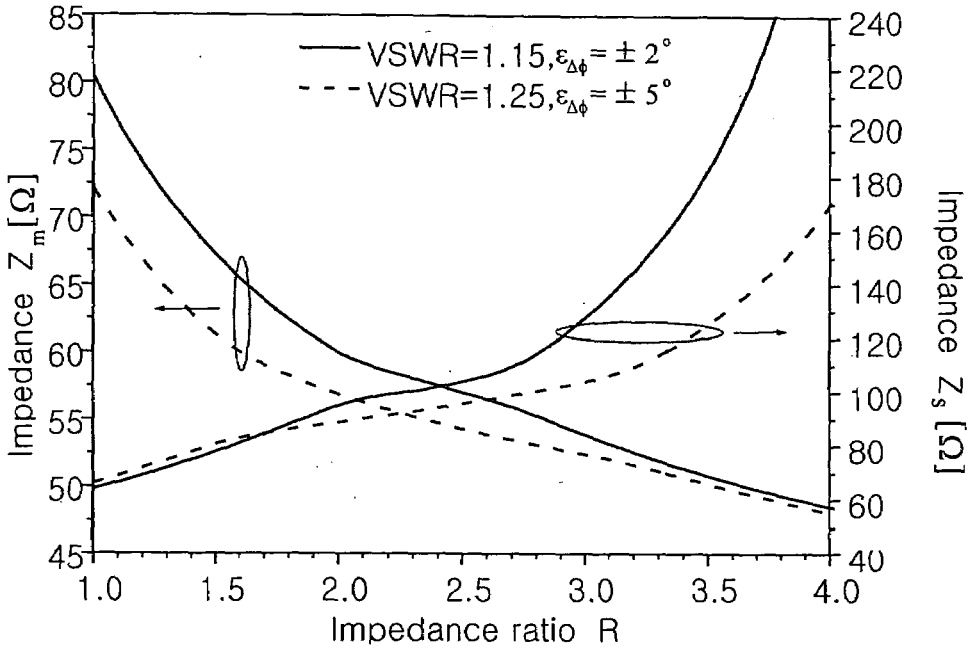
FIG. 5 is a graph showing optimal $Z_m$ and $Z_s$ values by R variations.

FIG. 5 is a graph showing optimal $Z_m$ and $Z_s$ values by R variations. In the relationship between the characteristic impedance $Z_m$ of the main transmission lines TL1 and TL2 and the characteristic impedance $Z_s$ of the stubs OSL1, OSL2, SSL1 and SSL2, the $Z_m$ value is decreased nonlinearly and, the $Z_s$ value is decreased nonlinearly, as the R value is increased.

Figure 6:
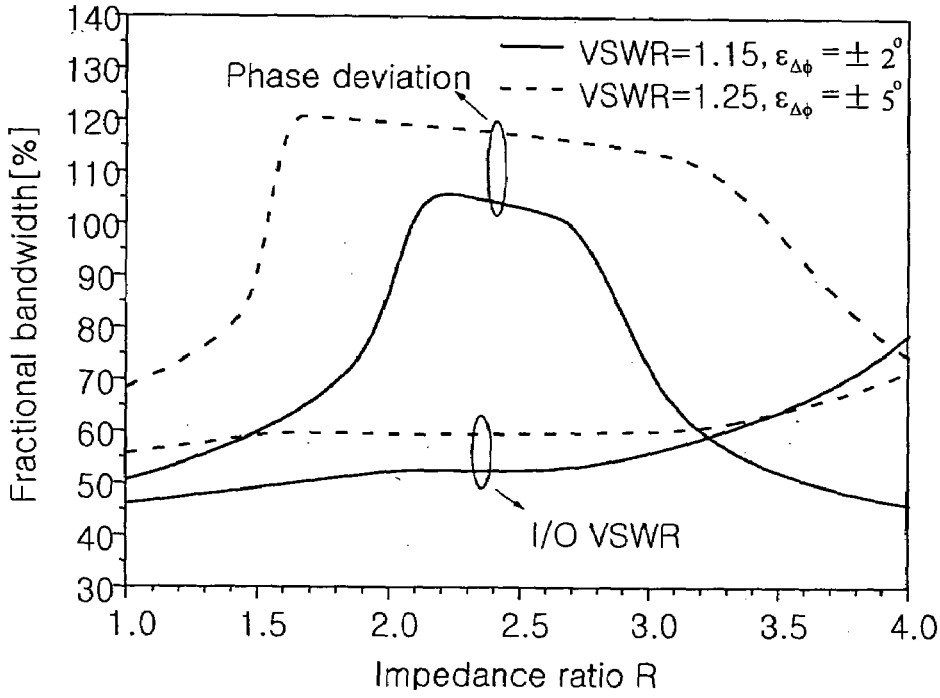
FIG. 6 is a graph illustrating an input/output VSWR and a phase bandwidth by R variations.

Also, under the same design conditions, the input/output match and phase bandwidths by R variations are given as shown in FIG. 6. If the design condition of the graph of FIG. 6 is alleviated from design condition I to design condition II, the bandwidths are increased remarkably and generally.

The phase bandwidth characteristic of the 180° phase shifter designed in accordance with the present invention appears up to 106.3% when the R value is about 2.2 under the design condition I, and appears up to 121% when the R value is about 1.6 under the design condition II.

Meanwhile, the input/output impedance match bandwidth is increased gradually as the R value is increased. This can be recognized from the graph of FIG. 5. As the R value is increased, the $Z_m$ value converges into 50 Ω gradually, while the $Z_s$ value is increased relatively sharply. Thus, the open and short stubs fail to perform properly in the second path network.

Figure 7A:
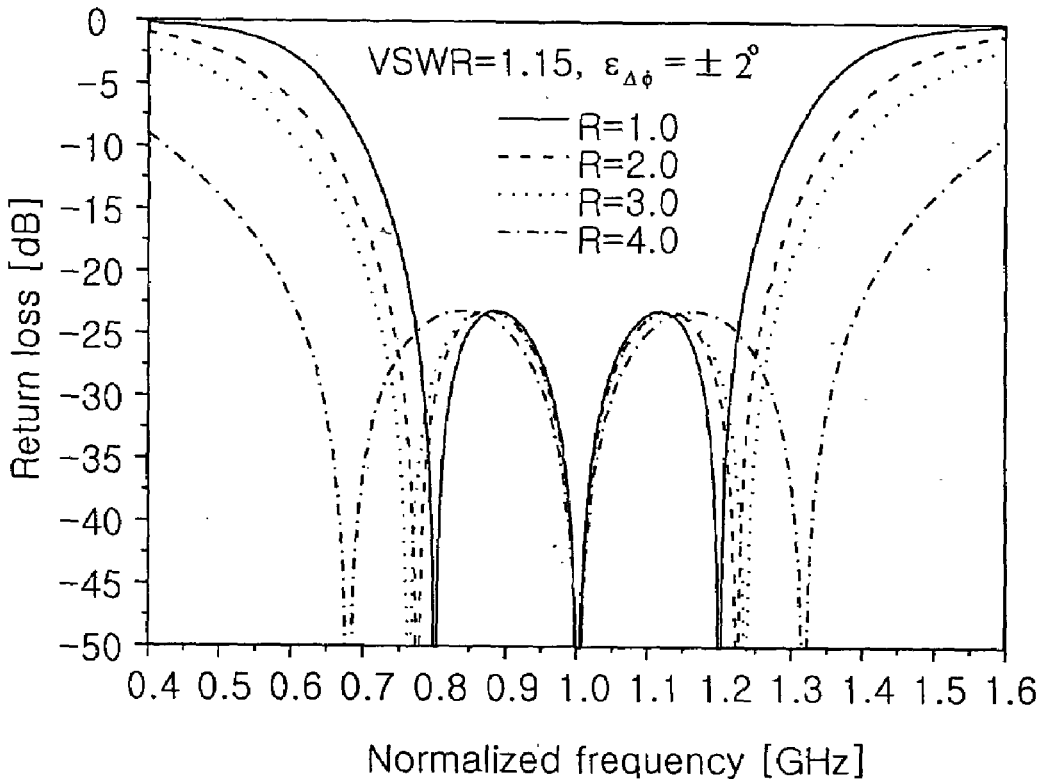
FIGS. 7A and 7B are graphs describing frequency response characteristics of input/output return loss by R variations.
Figure 7B:
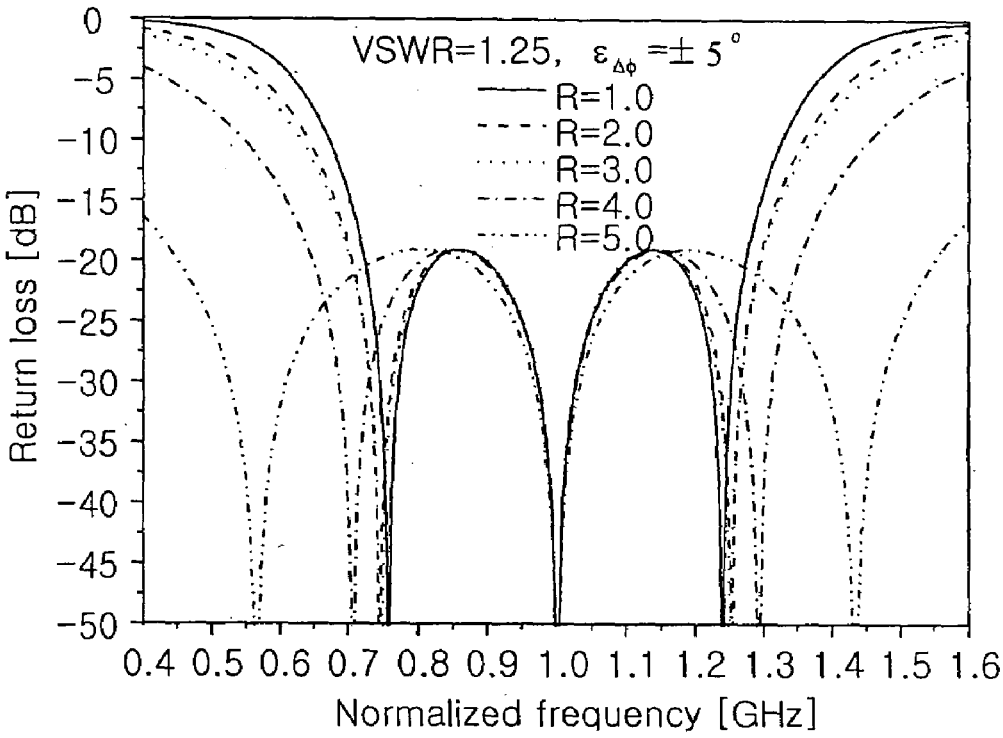
Figure 8A:
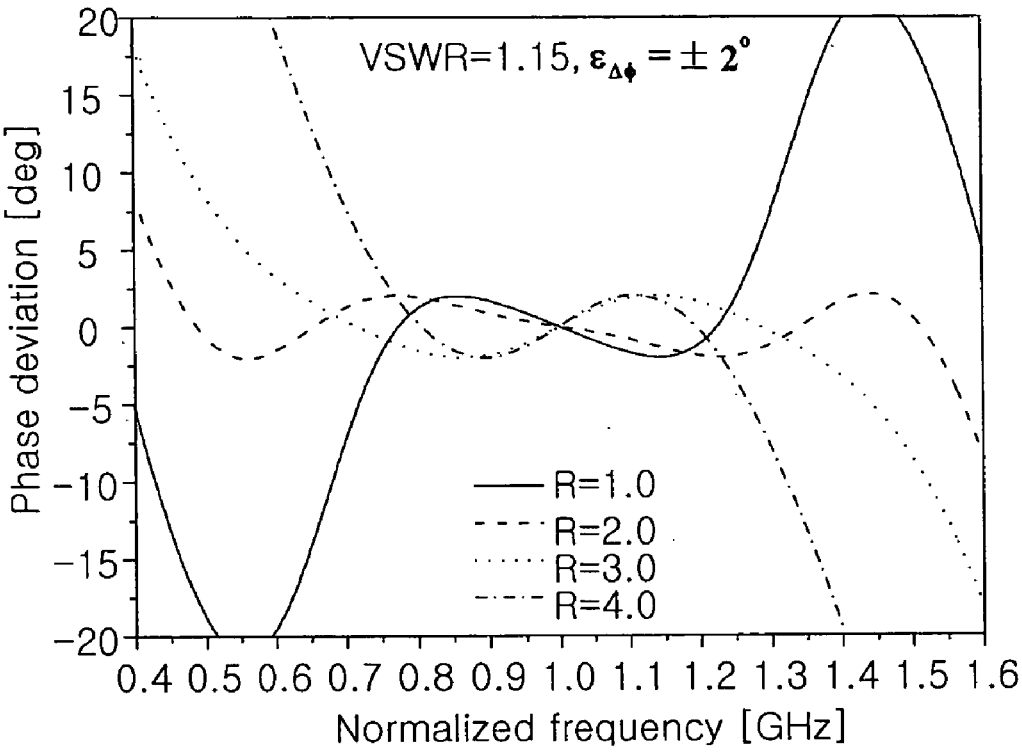
FIGS. 8A and 8B are graphs showing frequency response characteristics of phase deviation by R variations.
Figure 8B:
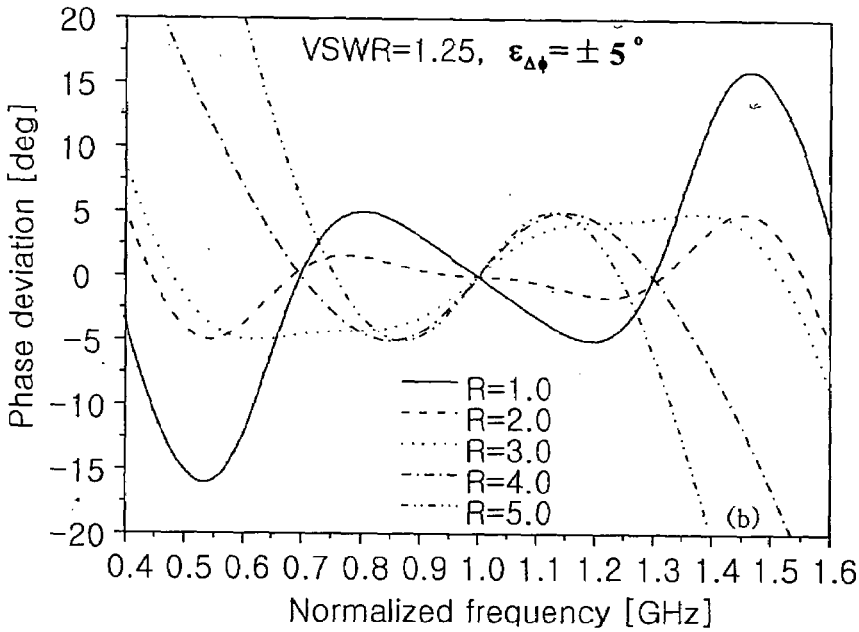

FIGS. 7A and 7B are graphs describing normalized frequency response characteristics of input/output return loss by R variations under the design condition I. FIGS. 8A and 8B are graphs showing normalized frequency response characteristics of phase deviation by R variations under the design condition II. Generally, the parallel stubs OSL1, OSL2, SSL1 and SSL2 connected to the main transmission lines TL1 and TL2 of a circuit show band-stop characteristics.

Therefore, the serious impedance degradation that appears in the frequency band out of the operating frequency is originated from the frequency restriction characteristic caused by the stubs. As the R value is increased in FIGS. 7A and 7B, the input/output impedance bandwidth is increased. This is because the stub impedance is increased more and more and the impedance of the main transmission lines TL1 and TL2 converges into around 50 Ω.

On the contrary, referring to FIGS. 8A and 8B, the bandwidth characteristic is increased and then decreased as the R value is varied. In order to verify the theory and design of the 180° broadband phase shifter proposed in the present invention under electrical conditions that the input/output VSWR=1.15:1 and the maximum phase deviation is no more than ±2, four kinds of phase shifters that operate at the center frequency of 3 GHz are fabricated using TLY-5A tefron substrates produced by Taconic company. The TLY-5A tefron substrates have a dielectric rate of 2.17, a substrate thickness of 20 mils, a copper foil thickness of 0.5 oz, and tangent loss of 0.0009 (@10 GHz). The feasible coupled line impedance ratio R is determined as 1.7 in consideration of tolerance of the HMIC technology. The lengths $\theta_m$ of the main transmission lines TL1 and TL2 are 0°, 10°, and 90°, respectively. When $\theta_m$ is 90°, the phase shifter does not use any coupled lines CL1 and CL2.

Also, a phase shifter with a standard Schiffman structure is fabricated to compare the phase characteristics of the 0°, 10°, and 90° phase shifters with those of the conventional standard Schiffman phase shifter, when R is 1.7. The design parameters of the phase shifters are summarized as Table 1 from the design graph of FIG. 3 obtained through simulation.

TABLE 1

Design parameter values of a standard network for the 180° phase shifter of the present invention

| Item | | $\theta_m$ 0° | $\theta_m$ 10° | $\theta_m$ 90° | Standard Schiffman |
|---|---|---|---|---|---|
| Main transmission line & Stubs | $Z_m$ | 63.8 Ω | 65.3 Ω | 80.5 Ω | 50.0 Ω |
| | $Z_s$ | 84.1 Ω | 80.6 Ω | 63.7 Ω | — |
| | $\theta_s$ | 45.0° | 45.0° | 45.0° | — |
| Coupled Line (R = 1.7) | $Z_{me}$ | 83.2 Ω | 85.1 Ω | — | 65.2 Ω |
| | $Z_{mo}$ | 48.9 Ω | 50.1 Ω | — | 38.3 Ω |
| | $\theta_c$ | 90.0° | 82.3° | — | 90.0° |

TABLE 1-continued

Design parameter values of a standard network for the 180° phase shifter of the present invention

| Item | | $\theta_m$ 0° | $\theta_m$ 10° | $\theta_m$ 90° | Standard Schiffman |
|---|---|---|---|---|---|
| Bandwidth | Input/output Match | 50.4% | 48.7% | 46.1% | ∞ (Match) |
| | Phase | 65.4% | 56.3% | 50.6% | 3.2% |

Referring to Table 1, the standard Schiffman phase shifter shows superior input/output match bandwidth, compared to the phase shifters of other structures proposed in the present invention. However, it has remarkably poor phase bandwidth. When the R value is given 1.7 for all the phase shifters and their main transmission line impedances are compared, that of the standard Schiffman phase shifter is the smallest. This means that the odd mode impedance $Z_{mo}$ of the coupled lines CL1 and CL2 is relatively small and it is difficult to form the coupled lines CL1 and CL2.

Figure 9A:
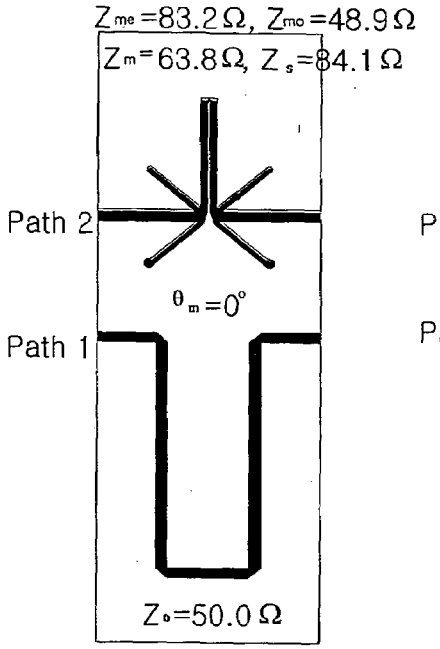
FIGS. 9A to 9C are diagrams showing 180° phase shifters fabricated in accordance with the present invention.
Figure 9B:
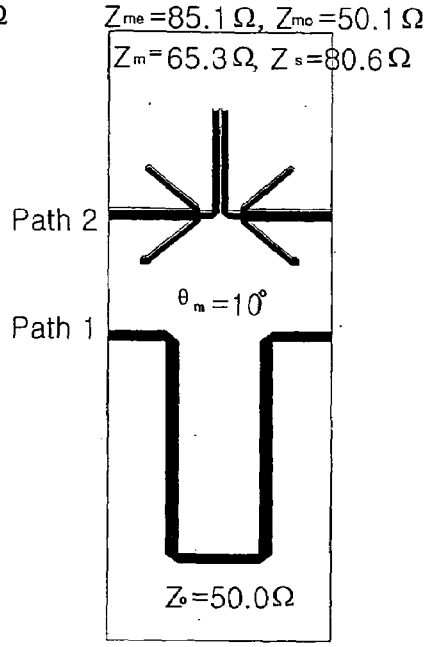
Figure 9C:
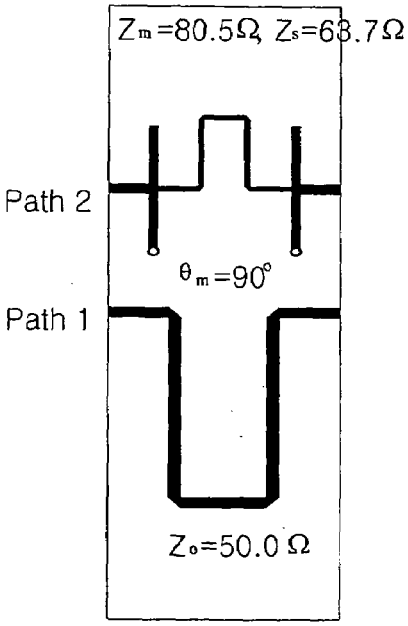
Figure 9D:
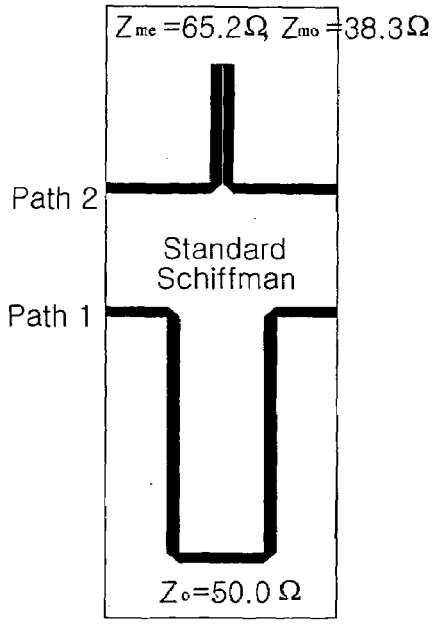
FIG. 9D is a diagram illustrating a 180° phase shifter with a standard Schiffman structure to be compared with the 180° phase shifters in FIGS. 9A to 9C.

FIGS. 9A to 9C are design layouts showing 180° phase shifters fabricated in accordance with the present invention, and FIG. 9D is a layout illustrating a 180° phase shifter with a standard Schiffman structure to be compared with the 180° phase shifters in FIGS. 9A to 9C.

Figure 10A:
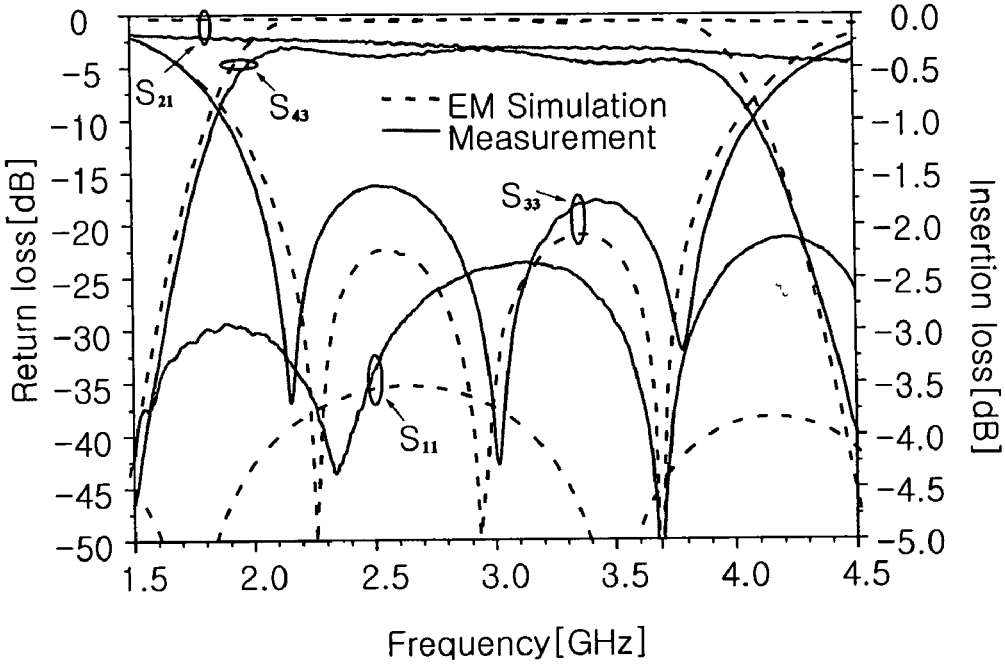
FIGS. 10A and 10B are graphs comparing simulated performances with measured ones in the 180° phase shifter whose $\theta_m$ value is 0° in FIG. 9A.
Figure 10B:
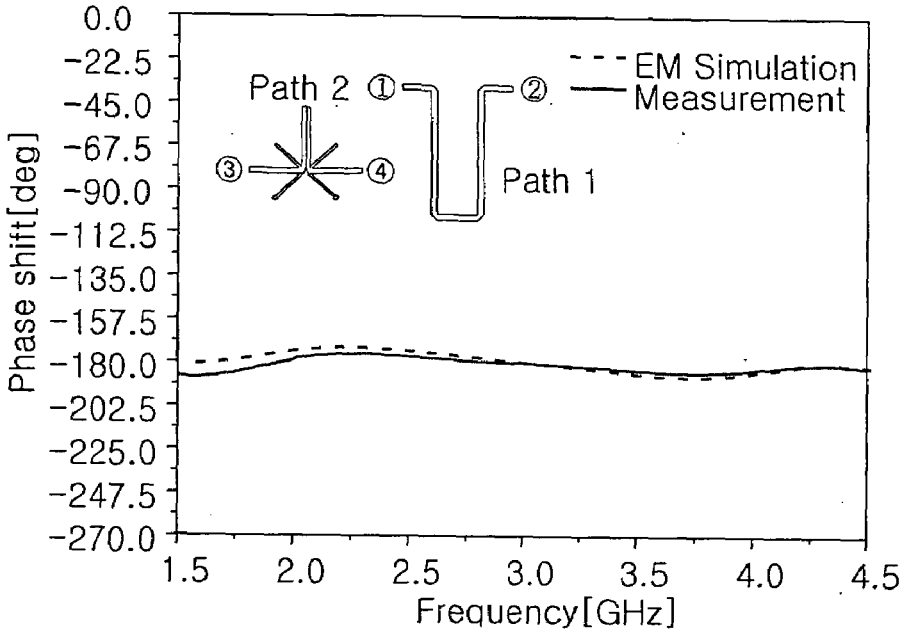
Figure 11A:
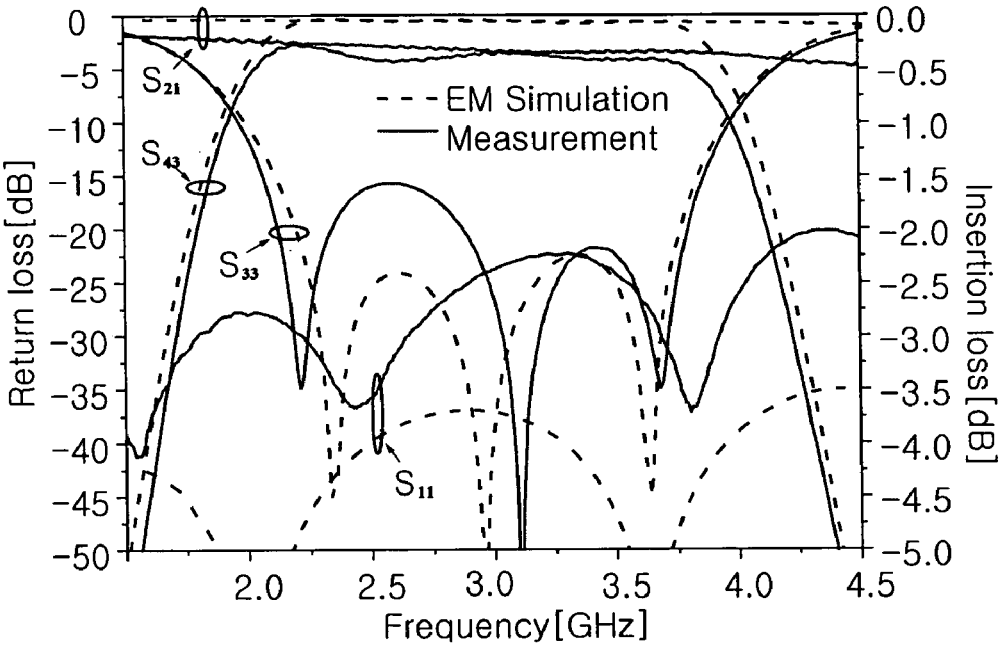
FIGS. 11A and 11B are graphs comparing simulated performances with measured ones in the 180° phase shifter whose $\theta_m$ value is 10° in FIG. 9B.
Figure 11B:
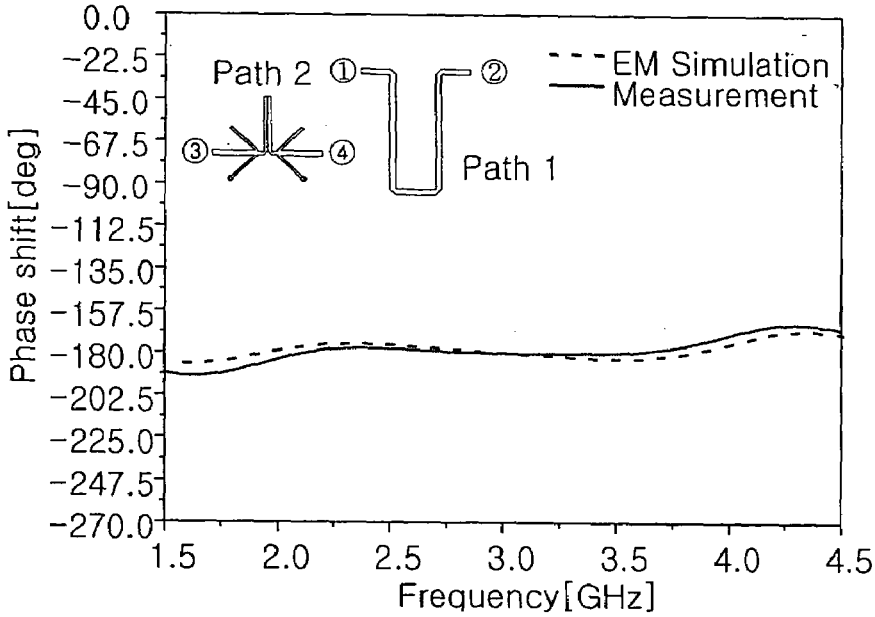
Figure 12A:
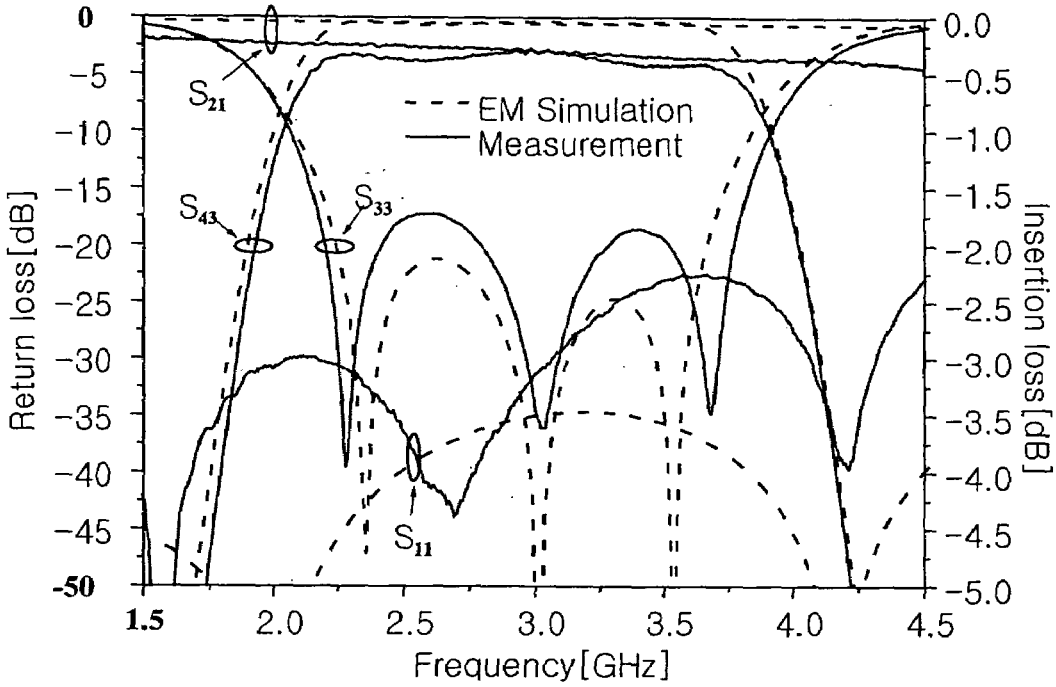
FIGS. 12A and 12B are graphs comparing simulated performances with measured ones in the 180° phase shifter whose $\theta_m$ value is 90° in FIG. 9C.
Figure 12B:
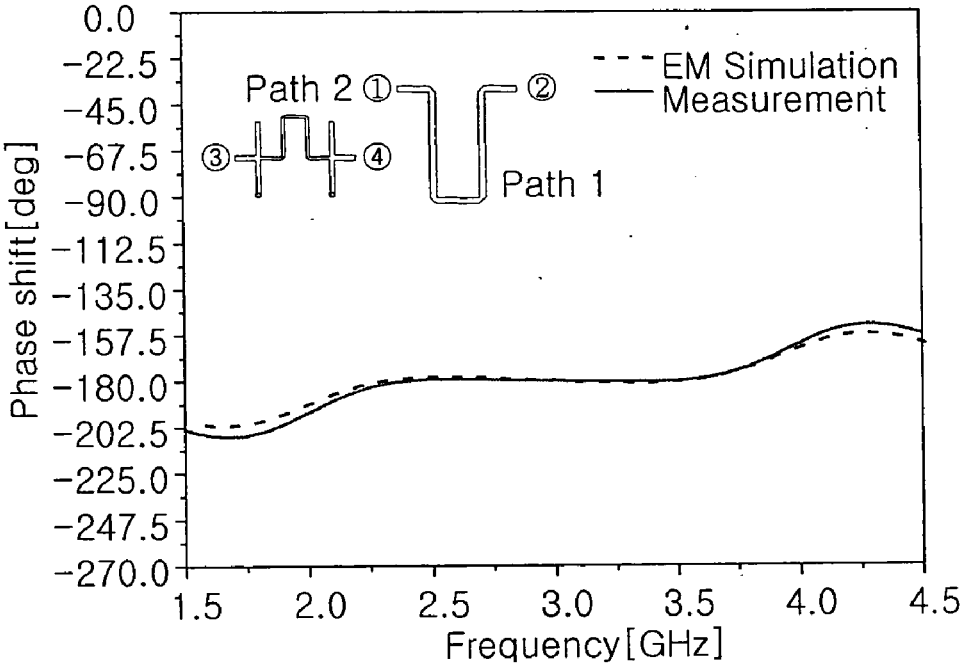
Figure 13A:
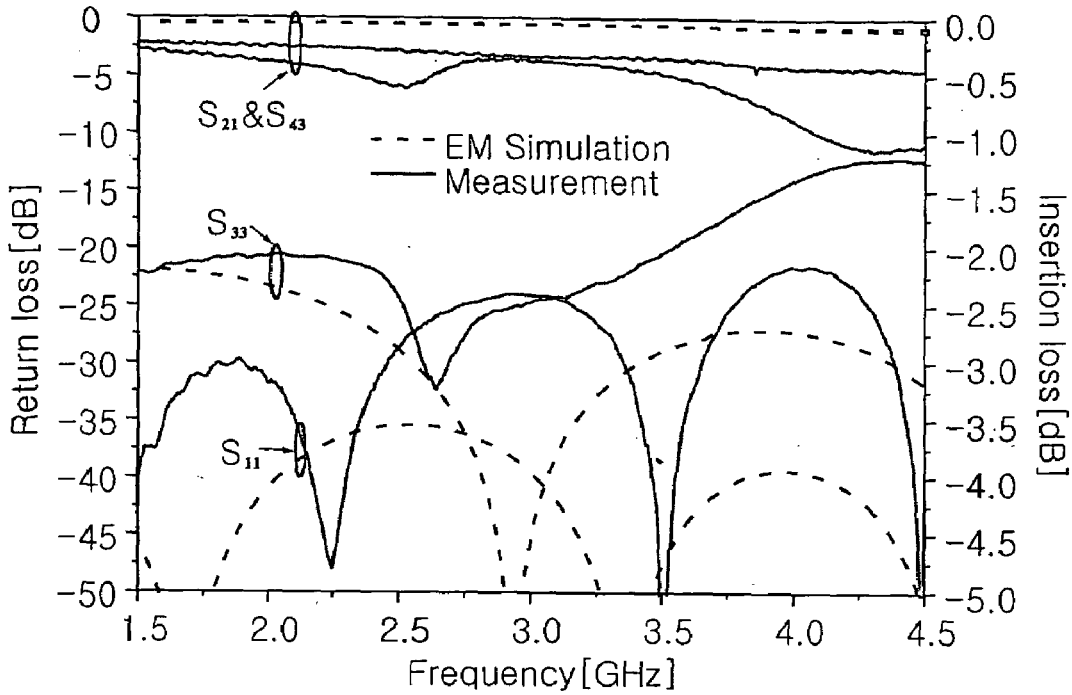
FIGS. 13A and 13B are graphs comparing simulated performances with measured ones in the 180° phase shifter with the standard Schiffman structure in FIG. 9D.
Figure 13B:
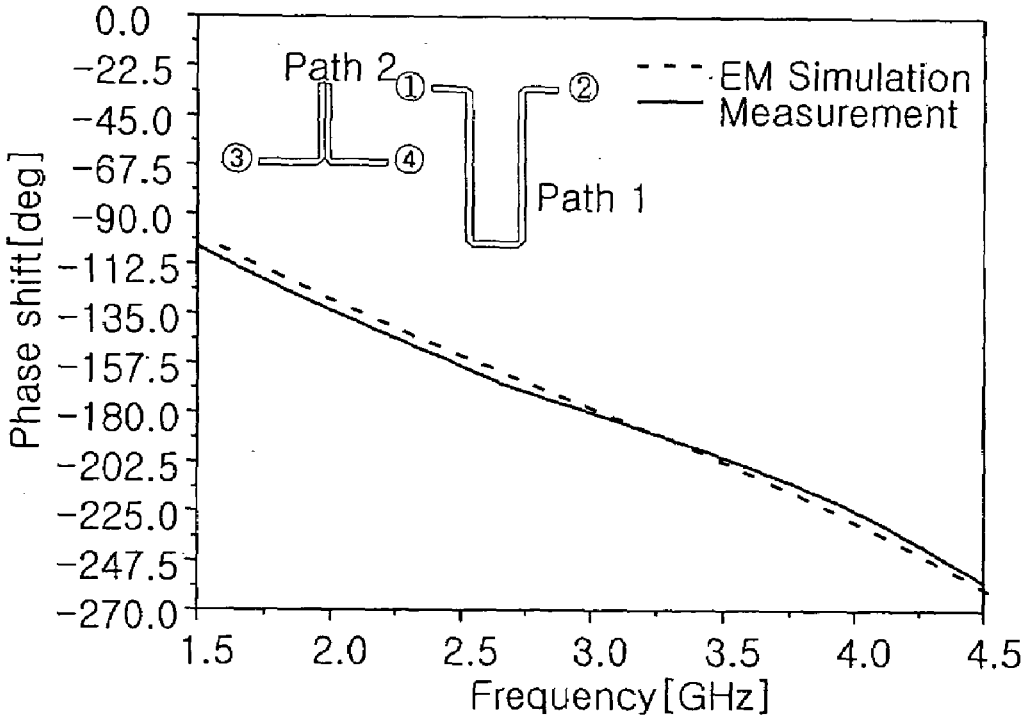

FIGS. 10A and 10B are graphs comparing simulated performances with measured ones in the 180° phase shifter whose $\theta_m$ value is 0° in FIG. 9A. FIGS. 11A and 11B are graphs comparing simulated performances with measured ones in the 180° phase shifter whose $\theta_m$ value is 100 in FIG. 9B. FIGS. 12A and 12B are graphs comparing simulated performances with measured ones in the 180° phase shifter whose $\theta_m$ value is 90° in FIG. 9C. FIGS. 13A and 13B are graphs comparing simulated performances with measured ones in the 180° phase shifter with the standard Schiffman structure in FIG. 9D. In these simulations, a commonly used electromagnetic (EM) simulator is used and the electrical performances are measured using an HP 8510C vector network analyzer.

The simulation results shown in the graphs of FIGS. 10A, 10B, 11A, 11B, 12A, 12B, 13A, and 13B are results including input/output connectors. They show that the output return loss is degraded and relatively broadbanded due to impedance variation of the coupled lines, which is caused by the characteristics of the connectors and under-etching of a printed circuit board (PCB).

There is a little difference in the input/output match and phase characteristics between the measured results and the EM simulation results or ideal results. However, the differences can be improved close to the EM simulation results or ideal results by correcting the characteristics of the connectors and reducing the PCB under-etching. Overall, the electrical characteristics of the measured results show a good agreement with those of the simulation results.

When the input/output return loss is 14 dB (or VSWR=1.5:1) and the maximum phase deviation is ±5, the bandwidths and the phase bandwidth characteristic are summarized as Table 2.

TABLE 2

| Item | Measured bandwidths of the 180° phase shifter proposed in the present invention | | | Standard Schiffman |
|---|---|---|---|---|
| | $\theta_m = 0°$ | $\theta_m = 10°$ | $\theta_m = 90°$ | |
| 14 dB Return Loss Bandwidth | 66.8% | 61.3% | 57.1% | ∞ (Match*) |
| ±5° Phase Bandwidth | 94.8% | 62.5% | 55.8% | 8.7% |

(*)12 dB return loss is considered.

The measured data of Table 2 shows that the input/output match and phase bandwidth characteristics are most excellent at $\theta_m$=0°. Since the conditions for measuring the performances are different, the measured bandwidth characteristics of Table 2 cannot be compared precisely with the ideal bandwidth characteristics of Table 1. However, it is clear that the 180° phase shifter with a structure proposed in the present invention can obtain broadband characteristics using Hybrid Microwave Integrated Circuit (HMIC) or Monolithic Microwave Integrated Circuit (MMIC) designing technology, compared to phase shifters with conventional structures.

The phase shifter of the present invention can obtain broadband characteristics by correcting the phase deviation for a desired phase shift with the ratio of a standard network between the characteristic impedance of the double parallel λ/8 (45°) open and short stubs, the characteristic impedance of the main transmission lines, and the coupling impedance of the coupled line. Since the standard network can provide stronger phase dispersive characteristic, a broadband phase shifter having a relatively large phase shift, such as 180° can be fabricated easily. In addition, the use of coupled line in the present invention helps miniaturize the circuit. Therefore, the technology of the present invention overcomes the shortcoming in manufacturing conventional phase shifters and fabricates a phase shifter both in the HMIC and MMIC technology.

While the present invention has been described with respect to certain preferred embodiments, it will be apparent to those skilled in the technology that various changes and modifications may be made without departing from the scope of the invention as defined in the following claims.

What is claimed is:

1. A broadband phase shifter, comprising:

a first path network including a reference standard transmission line whose input/output characteristic impedance is $Z_0$ and electrical length is $\theta_1$;

a second path network having two symmetrical main transmission lines connected to each other by a coupled line in the center and parallel open and short stubs connected to both ends of the two symmetrical main transmission lines, the main transmission lines having characteristic impedance $Z_m$ and an electrical length $\theta_m$ and the parallel open and short stubs having characteristic impedance $Z_s$ and an electrical length $\theta_s$; and a switching means for selecting only one path between the first path network and the second path network.

2. The broadband phase shifter as recited in claim 1, wherein the coupled line is of a single structure.

3. The broadband phase shifter as recited in claim 1, wherein the coupled line is of a double parallel structure.

4. The broadband phase shifter as recited in claim 1, wherein the reference standard transmission line of the first path network has an input/output characteristic impedance $Z_0$ and an electrical length $\theta_1$, the $Z_0$ and $\theta_1$, values being controllable according to a desired phase shift.

5. The broadband phase shifter as recited in claim 1, wherein the electrical length $\theta_1$ of the reference standard transmission line of the first path network has a value obtained by adding an additional electrical length to a basic phase shift designed at the center frequency $f_0$ of an operating frequency band to acquire the desired phase shift.

6. The broadband phase shifter as recited in claim 1, wherein the coupled line of the second path network has equivalent impedances $Z_{me}$ and $Z_{mo}$ for an even mode and an odd mode, an electrical length $\theta_c$, and coupling characteristics R relationship of $Z_{me}$, $Z_{mo}$, $\theta_c$, and R being expressed by:

$$Z_{me} = \sqrt{R}\,Z_m$$

$$Z_{mo} = \frac{Z_m}{\sqrt{R}}$$

$$\theta_c = \tan^{-1}\left(\sqrt{R\left\{\frac{1-\cos(180°-2\theta_m)}{1+\cos(180°-2\theta_m)}\right\}}\right)$$

where $R=Z_{me}/Z_{mo}$.

7. The broadband phase shifter as recited in claim 1, wherein the electrical length of the main transmission lines and the coupled line of the second path network is 180° at the center frequency.

8. The broadband phase shifter as recited in claim 1, wherein the electrical length of the parallel open and short stubs of the second path network is 45° at the center frequency.

9. The broadband phase shifter as recited in claim 1, wherein the phase slope based on the frequency of the second path network is determined by controlling the electrical length $\theta_m$ of the main transmission lines, characteristic impedance $Z_m$ of the main transmission lines, characteristic impedance $Z_s$ of the parallel stubs, and the coupling characteristic R of the coupled line.

10. The broadband phase shifter as recited in claim 1, wherein the switching means selects only one path between the first path network and the second path network through toggle switching between a pair of a first diode and a second diode connected to the first path network and a pair of a third diode and a fourth diode connected to the second path network.

11. The broadband phase shifter as recited in claim 5, wherein the basic phase shift designed at the center frequency $f_0$ of the operating frequency band is 180°.

12. The broadband phase shifter as recited in claim 1, wherein the characteristic impedance of the main transmission lines of the second path network is increased non-linearly as the electrical length of the main transmission lines of the second path network is increased, and the characteristic impedance of the open and short stubs of the second path network is decreased non-linearly as the electrical length of the main transmission lines of the second path network is increased.

13. The broadband phase shifter as recited in claim 1, wherein the characteristic impedance of the main transmission lines of the second path network is decreased non-linearly as the coupling characteristic of the coupled line of the second path network is increased, and the characteristic impedance of the open and short stubs of the second path network is increased non-linearly as the coupling characteristic of the coupled line of the second path network is increased.

* * * * *